US005937834A

United States Patent [19]

Oto

[11] Patent Number: 5,937,834

[45] Date of Patent: Aug. 17, 1999

[54] EXHAUST GAS RECIRCULATION APPARATUS

[75] Inventor: Takashi Oto, Kawawaki, Japan

[73] Assignee: Isuzu Motors, Tokyo, Japan

[21] Appl. No.: 08/955,440

[22] Filed: Oct. 21, 1997

[30] Foreign Application Priority Data

Oct. 24, 1996 [JP] Japan ..... 8-282353

[51] Int. Cl.[6] ..... F02M 25/07

[52] U.S. Cl. ..... 123/568.18; 123/568.15; 123/568.2; 60/605.2

[58] Field of Search ..... 123/568.18, 568.15, 123/568.2; 60/605.2

[56] References Cited

U.S. PATENT DOCUMENTS

| | | | |
|---|---|---|---|
| 1,051,690 | 1/1913 | Colwell | 123/568.18 |
| 1,541,583 | 6/1925 | Merz | 123/568.18 |
| 3,971,351 | 7/1976 | McKee | 123/568.15 |
| 4,027,635 | 6/1977 | Goto et al. | 123/568.15 |
| 4,206,606 | 6/1980 | Yamada | 60/605.2 |
| 4,222,356 | 9/1980 | Ueda et al. | 123/568.18 |
| 4,237,837 | 12/1980 | Toda et al. | 123/568.18 |
| 4,329,965 | 5/1982 | Ueda et al. | 123/568.18 |
| 4,796,594 | 1/1989 | Duret | 123/568.15 |
| 5,682,746 | 11/1997 | Von Hoerner | 60/605.2 |

*Primary Examiner*—Willis R. Wolfe
*Attorney, Agent, or Firm*—Staas & Halsey

[57] ABSTRACT

An exhaust gas recirculation apparatus capable of preventing the occurrence of dewing inside an exhaust gas recirculation pipe after the engine stop and corrosion inside the exhaust gas recirculation pipe, an EGR valve, a reed valve, etc., and eventually capable of improving engine durability and engine life. This exhaust gas recirculation apparatus includes an exhaust gas recirculation pipe having an EGR valve for controlling an exhaust recirculation quantity and connected between an exhaust passage and an intake passage in an internal combustion engine equipped with a supercharger, and a check valve for preventing intake air from flowing into the exhaust gas recirculation pipe when an internal pressure of the exhaust gas recirculation pipe is lower than an internal pressure of the intake passage, disposed at the junction between the exhaust gas recirculation pipe and the intake passage, wherein the check valve has a clearance for communication between the exhaust gas recirculation pipe and the intake passage while the engine stops.

5 Claims, 5 Drawing Sheets

EXHAUST GAS RECIRCULATION APPARATUS

BACKGROUND OF THE INVENTION

This invention relates to an exhaust gas recirculation apparatus of an internal combustion engine equipped with a supercharger such as a Diesel engine equipped with a supercharger.

Among counter-measures for exhaust gases of internal combustion engines such as a Diesel engine, exhaust gas recirculation (hereinafter referred to as "EGR") for restricting the formation of NOx by recirculating a part of the exhaust gas as an inert gas to an intake and lowering a combustion temperature so as to reduce the emission quantity of NOx in the exhaust gas has been known as effective and has therefore been put widely to practical application.

Japanese utility model application Kokai publication No. 6-40343 proposes an exhaust gas recirculation apparatus shown in FIG. 5 of the accompanying drawings for an internal engine equipped with a supercharger for effecting such an exhaust gas recirculation. This exhaust gas apparatus includes an exhaust gas recirculation pipe 1 for connecting an exhaust manifold 14 to an intake pipe 11 of an engine 13, and a reed valve 40 disposed at the connection portion between the exhaust gas recirculation pipe 1 and the intake manifold 12 as shown in FIG. 7 so that this reed valve 40 can close and open an open portion 5 formed at the connection portion.

In this exhaust gas recirculation apparatus, the EGR is effected only when the number of revolution of the engine and its load fall within a certain range. However, when the EGR is effected in a range where a mean boost pressure is higher than a mean exhaust pressure, the reed valve 40 is opened so as to reliably execute the EGR when the pulsating exhaust pressure Pe is greater than the boost pressure Pb (oblique line portion) as represented by a pressure Pv-crank angle CA graph in FIG. 6. The reed valve 40 is closed at other times so as to prevent backflow from the intake system into the exhaust gas recirculation pipe 1 and thus to reduce NOx and to prevent the drop of engine performance.

In the exhaust gas recirculation apparatus described above, when the operation is completed while the EGR operation state is switched to the non-operation state, the engine and the exhaust gas recirculation pipe radiate heat after the stop of the operation and the temperature drops. Therefore, the moisture contained in a combustion gas remaining inside the exhaust gas recirculation pipe between the EGR valve and the reed valve dews.

Soot in the combustion gas that adheres to the inner surface of the exhaust gas recirculation pipe dissolves in this dewing water and generates strongly acidic water containing sulfuric acid ions and nitric acid ions. Because this sulfuric acid remarkably corrodes the exhaust gas recirculation pipe, there remains the problem that engine life is shortened.

BRIEF SUMMARY OF THE INVENTION

The present invention has been completed in order to solve the problem described above, and aims at providing an exhaust gas recirculation apparatus constituted so that it can diffuse an exhaust gas remaining inside an exhaust gas recirculation pipe into an intake pipe side or can emit it to the atmosphere at the stop of an engine, and so that it can prevent the occurrence of dewing inside the exhaust gas recirculation pipe even when it is left cooling after the stop of the engine. Being capable of preventing dewing, this exhaust gas recirculation apparatus can prevent also the corrosion inside the exhaust gas recirculation pipe and can prevent a defective operation and breakage of an EGR valve, a reed valve, etc., resulting from the corrosion. Consequently, this apparatus can improve engine durability and engine life.

In an exhaust gas recirculation apparatus including an exhaust gas recirculation pipe having an EGR valve for controlling an exhaust gas recirculation quantity and so connected as to extend from an exhaust passage of an internal combustion engine equipped with a supercharger to an intake passage, and a check valve for preventing an intake air from flowing into the exhaust gas recirculation pipe when an internal pressure of the exhaust gas recirculation pipe is lower than an internal pressure of the intake passage, disposed at the connection portion between the exhaust gas recirculation pipe and the intake passage, the object of the invention described above can be accomplished by an exhaust gas recirculation apparatus wherein the check valve has a clearance for communication between the exhaust gas recirculation pipe and the intake passage when the engine is at halt.

The check valve described above is constituted by a reed valve comprising a flat valve seat and a reed having a warp providing a clearance between the reed and the valve seat at the distal end of the reed, under a free state. The check valve is constituted by a reed valve comprising a flat sheet-like reed and a valve seat shaped into a convexed shape so as to define a clearance expanding toward the distal end side of the lead under a free state and provided between the reed and the valve seat.

According to the present invention described above, the exhaust gas remaining inside the exhaust gas recirculation pipe can be diffused into the intake pipe from the clearance of the check valve when the engine is at halt. Therefore, even when the exhaust gas recirculation pipe is left standing for cooling after the stop of the engine, the occurrence of dewing inside the exhaust gas recirculation pipe can be prevented.

In an exhaust gas recirculation apparatus including an exhaust gas recirculation pipe so connected as to extend from an exhaust passage of an internal combustion engine equipped with a supercharger to an intake passage and a check valve disposed at the junction between the exhaust gas recirculation pipe and the intake passage, for preventing an intake air from flowing into the exhaust gas recirculation pipe when an internal pressure of the exhaust gas recirculation pipe is lower than an internal pressure of the intake passage, the present invention provides also an exhaust gas recirculation apparatus wherein an open valve for opening the exhaust gas recirculation pipe to the atmosphere at the completion of recirculation of an exhaust gas is disposed on the exhaust gas upstream side of the check valve.

According to the present invention, the exhaust gas remaining inside the exhaust gas recirculation pipe can be discharged into the atmosphere when recirculation of the exhaust gas is completed. Therefore, even when the exhaust gas recirculation pipe is left standing for cooling, the occurrence of dewing inside the exhaust gas recirculation pipe can be prevented.

When the open valve is a three-way valve operating in such a manner as to open the exhaust gas recirculation pipe to the atmosphere for a predetermined time and then to close it after the stop of the engine, the exhaust gas recirculation pipe can be opened for a predetermined time and can be then closed. Accordingly, foreign matters such as dust, worms, etc., can be prevented from entering the exhaust gas recirculation pipe from outside.

Because the check valve secures the clearance at the neutral position, adhesion and deposition of soot, carbon, etc, to the open portion of the reed valve can be prevented, and fixation of the reed portion can be prevented, too.

Accordingly, the present invention can prevent the occurrence of dewing inside the exhaust gas recirculation pipe. In consequence, corrosion of the exhaust gas recirculation pipe can be prevented and furthermore, the operation defect and breakage resulting from the corrosion of the EGR valve main body and the reed valve, etc. can be prevented. As a result, durability of the engine can be improved and engine life can be drastically prolonged.

DETAILED DESCRIPTION OF THE INVENTION

Hereinafter, the first embodiment of the present invention will be explained with reference to the accompanying drawings.

Figure 5:
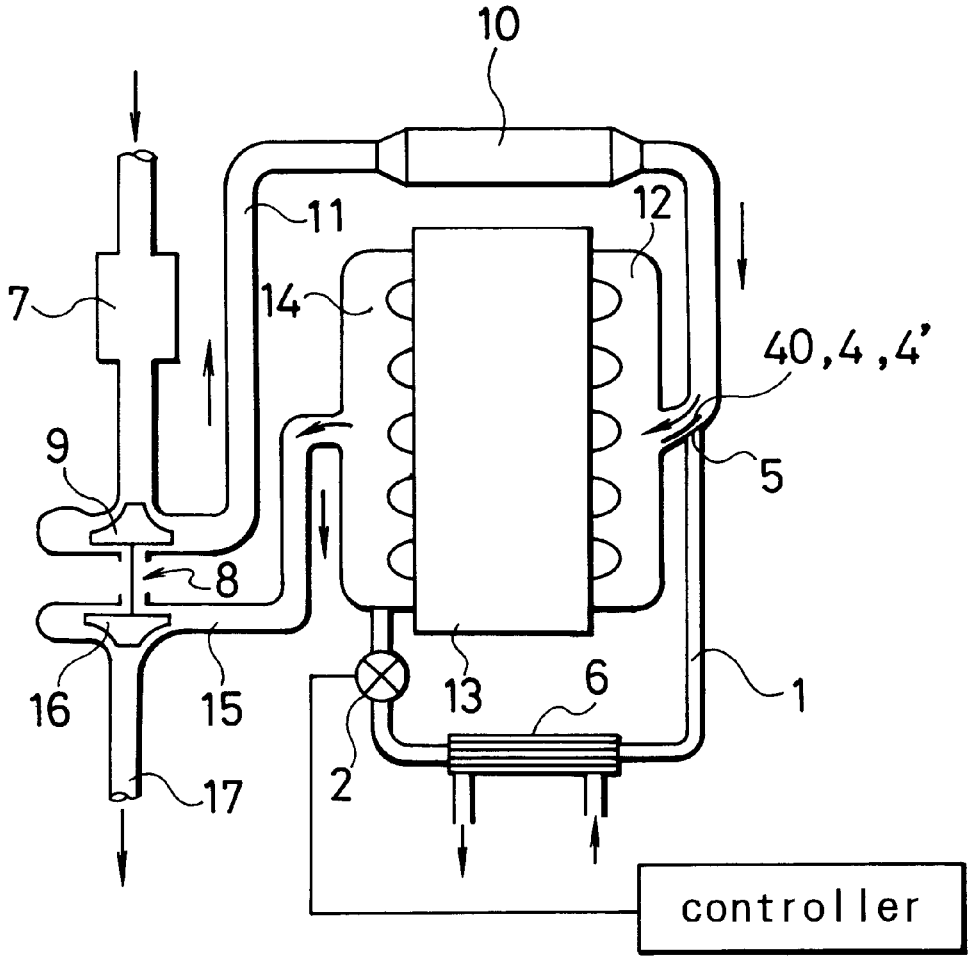
FIG. 5 is a structural view of an engine equipped with a supercharger.
Figure 6:
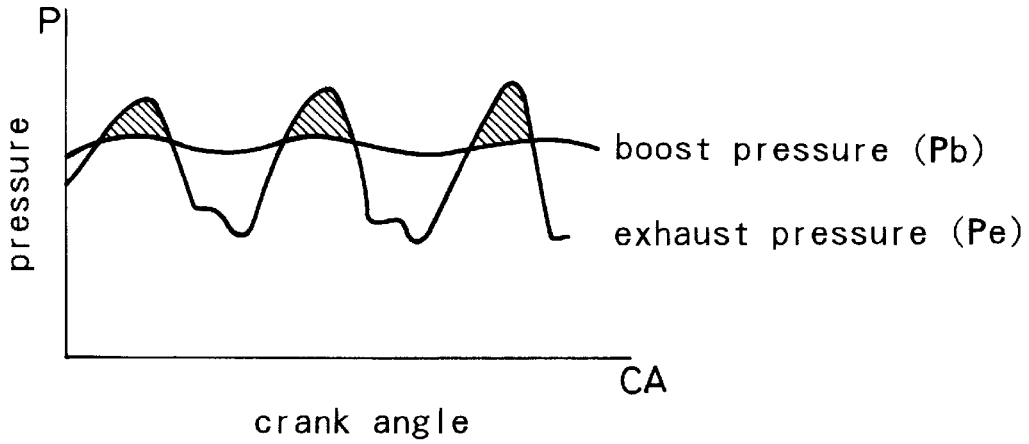
FIG. 6 is a diagram of a pressure-crank angle and shows the relation between a boost pressure and an exhaust pressure.
Figure 7:
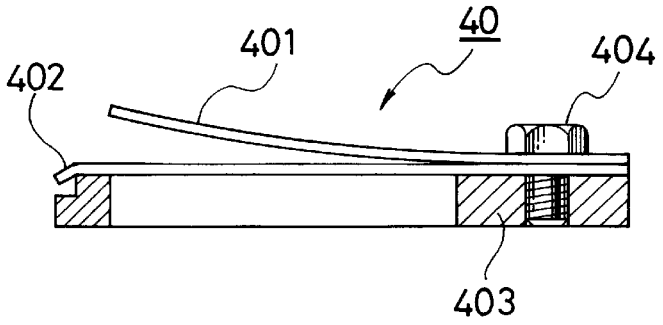
FIG. 7 is a partial sectional view of a reed valve according to the prior art.

First, FIG. 5 shows the construction of an engine with a supercharger which has an exhaust gas recirculation apparatus. A supercharger 8 is provided to an engine 13, and an intake piping having an air cleaner 7 as an intake passage is connected to a compressor portion 9 of the supercharger 8. Further, an intake duct line 11 having an intercooler 10 is so disposed as to extend from this compressor portion 9 to an intake manifold 12.

On the other hand, an exhaust pipe 15 extending from an exhaust manifold 14 and connected to an exhaust turbine portion 16 of the supercharger 8 and an exhaust piping 17 connected to this exhaust turbine 16 are provided as an exhaust gas passage.

An exhaust gas recirculation pipe 1 which has an EGR valve 2 and an EGR cooler 6 and connects the exhaust manifold 14 to the intake pipe 11 is disposed for EGR (exhaust gas recirculation). A check valve 4 is disposed at an open portion 5 of the junction between the exhaust gas recirculation pipe 1 and the intake pipe 11. Opening/closing of the EGR valve 2 is controlled by a controller 3 in accordance with the state of the engine 13 so as to control the recirculation rate of the exhaust gas cooled by the EGR cooler 6.

This check valve 4 prevents intake air from flowing into the exhaust gas recirculation pipe 1 when the internal pressure of the exhaust gas recirculation pipe 1 is lower than the internal pressure of the intake passage 11. The check valve 4 has a clearance to permit communication between the exhaust gas recirculation pipe 1 and the intake passage 11 while the engine operation is at halt.

Figure 1:
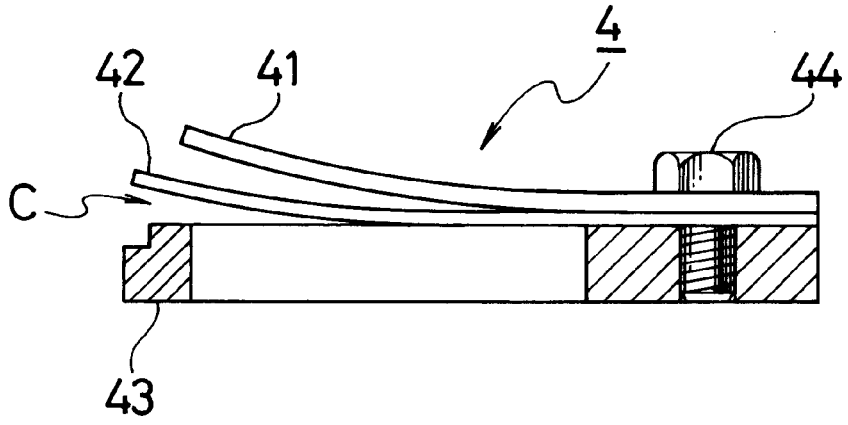
FIG. 1 is a partial sectional view of a reed valve according to an embodiment of the present invention.

This check valve 4 uses a reed valve 1 having the construction shown in FIG. 1 wherein a reed 42 and a stopper 41 are fixed to an open portion of a valve seat 43 having a flat seat surface by a set screw 44 and the reed 42 has a warp such that it has a clearance C expanding toward the distal end thereof and provided between it and the valve seat 43 under a free state. The term "free state" means the neutral state in which the internal pressure of the exhaust gas recirculation pipe 1 is equal to that of the intake passage 11.

When the pressure on the side of the exhaust gas recirculation pipe 1 is equal to the pressure on the side of the intake passage 11 in this reed valve 4, the clearance C is defined between the original shape of the reed 42 and the valve seat 43, so that the exhaust gas can be caused to flow out towards the intake pipe 11 side. As the pressure difference between the exhaust gas side and the intake side increases and exceeds the resilient force of the reed 42, however, the reed 42 is pushed to the valve seat 43 and the valve 43 is closed, thereby preventing the intake air from flowing into the exhaust gas recirculation pipe 1. The stopper 41 controls opening of the reed 42 when the reed 42 operates, and limits the maximum open area when the valve is open.

Figure 2:
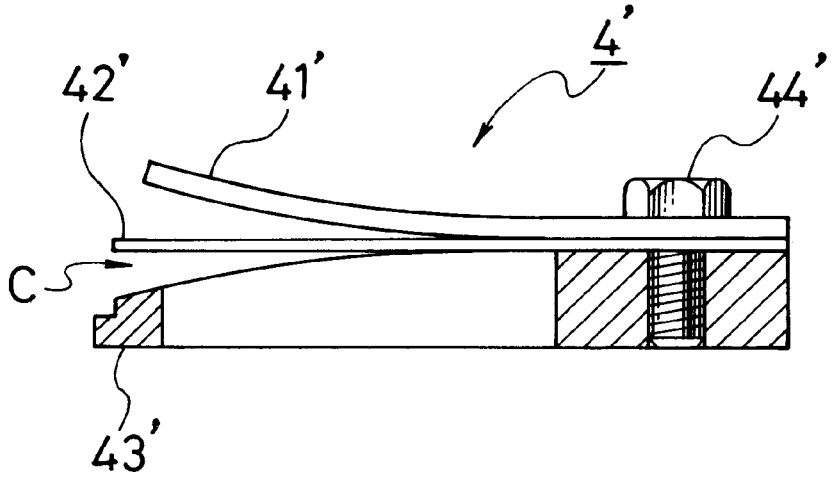
FIG. 2 is a partial sectional view of a reed valve according to another embodiment of the present invention.

Further, the check valve 4 is constituted in such a manner as to define the clearance C expanding towards the distal end side of the reed 42' and provided between a seat and this reed 42' as shown in FIG. 2. More concretely, the reed 42' and the stopper 41', that are flat sheets under the free state, are fixed by a set screw 44' to the open portion of the valve seat 43' having a convexed seat surface so as to define the reed valve 4'.

The operation of the reed valve 4' shown in FIG. 2 is the same as that of the reed valve 4 shown in FIG. 1. When the check valve 4 is the reed valve 4' having such a structure shown in FIG. 2, the correct clearance C can be defined by the flat sheet-like reed 42' and the valve seat 43' having a curved surface. Therefore, accuracy control of the clearance C becomes easier.

Figure 3A:
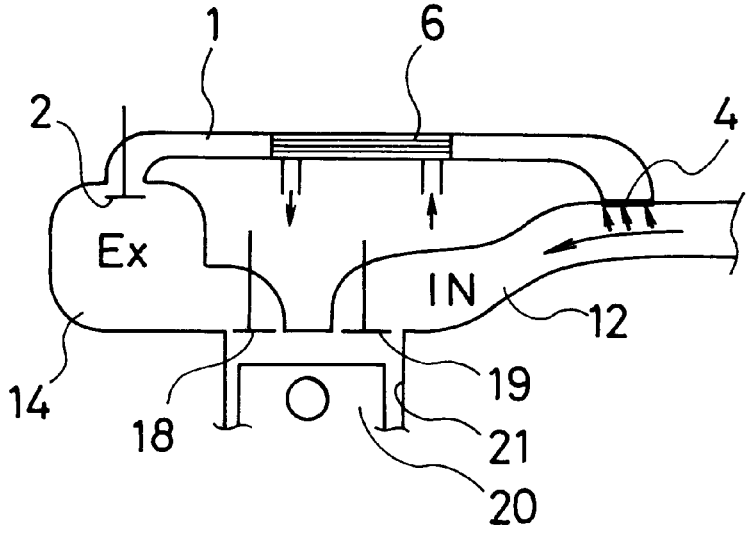
FIG. 3(*a*) and FIG. 3(*b*) are partial sectional views of an engine and are useful for explaining the operation of a check valve according to the first embodiment of the present invention, wherein FIG. 3(*a*) shows the engine at the time of an EGR operation and FIG. 3(*b*) shows the engine at the stop of the operation.
Figure 3B:
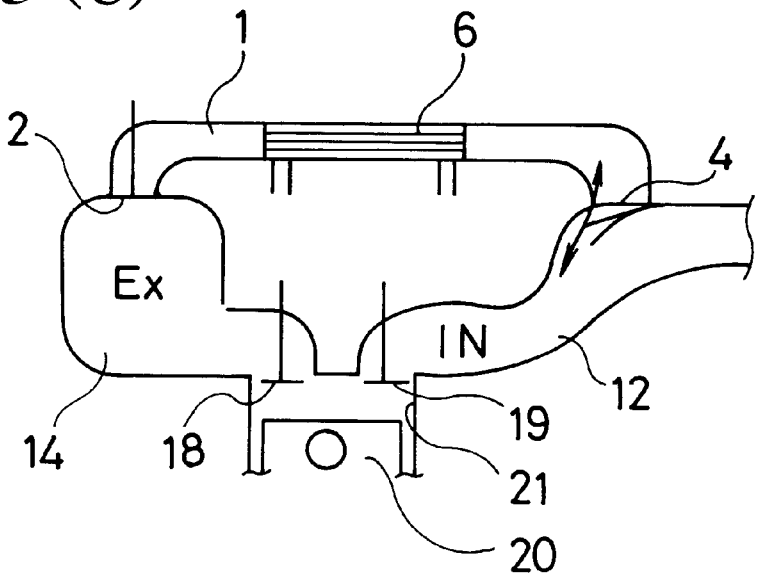

According to the construction of this first embodiment of the present invention, each check valve 4, 4' comprising the reed valve 4, 4' is opened and closed depending on the pressure difference between the exhaust pressure Pe and the boost pressure Pb while the EGR valve 2 is opened and executes the EGR as shown in FIG. 3(*a*). In other words, the check valve 4, 4' is opened to conduct the EGR when the exhaust gas pressure Pe is greater than the boost pressure Pb, i.e. Pe>Pb, and when Pe<Pb, on the contrary, the check valve is closed to prevent backflow of fresh air as shown in FIG. 3(*a*).

While the engine 13 is at halt, intake air and the residual gas can communicate with each other through the clearance, which allows communication between the exhaust gas recirculation pipe 1 and the intake pipe 11 as the intake passage as represented by an arrow, because the check valve 4 has such a clearance as shown in FIG. 3(*b*). Due to this interchange, the residual combustion gas inside the exhaust gas recirculation pipe 1 can be diffused into the intake pipe 11. As a result, dewing inside the exhaust gas recirculation pipe 1, and eventual corrosion, can be prevented.

The same effect can be obtained, too, when the boost pressure Pb on the side of the intake pipe 11 is low during the operation of the engine 13.

Such a check valve 4 can be accomplished by the reed valves 4 and 4' shown in FIGS. 1 and 2. In other words, while the engine operation stops, the pressure inside the exhaust gas recirculation pipe 1 and the pressure inside the intake pipe 11 reach the equilibrium and the reed valves 42 and 42' are under the free state. At this time, the residual combustion gas inside the exhaust gas recirculation pipe 1 can be diffused via the clearance C as the static clearance to the intake pipe 11.

Moreover, accuracy control of the clearance C becomes easier by employing the construction of the reed valve 4' shown in FIG. 2, and because a great clearance C can be secured, the residual combustion gas can be diffused quickly.

Further, the problem of the fixation of the reed portion and the defective valve opening operation of the reed valve due to adhesion and deposition of soot and carbon to the open portion of the reed portion can be solved, as well. In other words, because the reed valve keeps the clearance C at the neutral position, the soot can be diffused via this clearance and its adhesion can be reduced. Because adhesion of the soot can be thus reduced, fixation of the reed portion can be prevented, too.

Figures 4A, 4B, 4C:
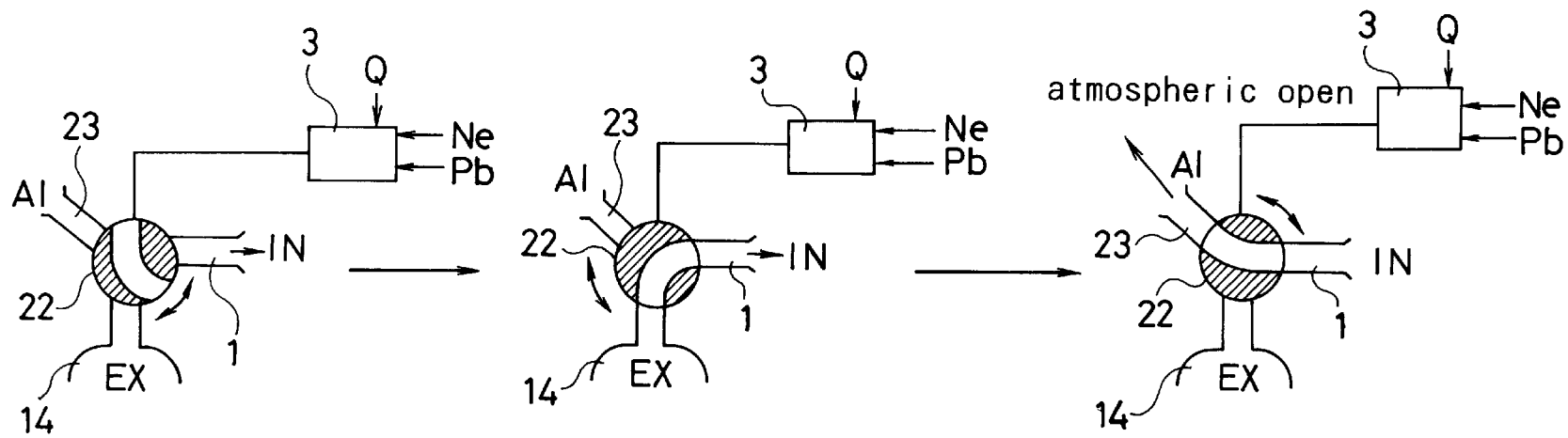
FIG. 4 (*a*), FIG. 4(*b*) and FIG. 4(*c*) are explanatory views showing the operation state of a three-way valve according to the second embodiment of the present invention, wherein FIG. 4(*a*) shows a closed state, FIG. 4(*b*) shows an EGR state and FIG. 4(*c*) shows an atmosphere open state.

Next, the second embodiment is shown in FIGS. 4 and 5. As the check valve 40 disposed at the open portion 5 of the junction between the exhaust gas recirculation pipe 1 and the intake pipe 11, this embodiment employs a check valve having the construction which closes the open portion 5 when the engine stops and opens the passage only when the internal pressure of the exhaust gas recirculation pipe 1 is higher than the internal pressure of the intake pipe 11. Various valves can be employed as this check valve 40 such as a reed valve or such a type in which the valve disc is pushed to the valve seat by a spring.

An atmosphere open valve 22 is disposed on the upstream side of the exhaust gas recirculation pipe 1 relative to the check valve 40. This atmosphere open valve 22 is constituted in such a manner as to open the exhaust gas recirculation pipe 1 to the atmosphere when it is controlled by the controller 3 after the end of recirculation of the exhaust gas, that is, after the EGR is completed.

In this embodiment, the atmosphere open valve may be disposed separately from the EGR valve 2, but a three-way valve 22 may be used as shown in FIG. 4. The connection portions of the three-way valve 22 are connected to the side AI of the atmosphere open piping 23, the side EX of the exhaust manifold 14 and the side IN of the exhaust gas recirculation pipe 1. This three-way valve 22 is controlled to the state where the valve is fully closed as shown in FIG. 4(*a*), to the state where the side EX of the exhaust manifold 14 communicates with the side IN of the exhaust gas recirculation pipe 1 as shown in FIG. 4(*b*) and to the state where the side IN of the exhaust gas recirculation pipe 1 communicates with the side AI of the atmosphere open piping 23 as shown in FIG. 4(*c*). The three-way valve 22 is controlled by the controller 3 using the engine torque Q, its number of revolution Ne and the boost pressure Pb as the inputs thereof.

Preferably, the open valve and the three-way valve 22 are controlled so that the exhaust gas recirculation pipe 1 is opened to the atmosphere for the time during which the major proportion of the exhaust gas can be discharged, that is, for a predetermined time, after the stop of the engine operation, and after this atmosphere opening is made, the exhaust gas recirculation pipe 1 is closed.

The time for this atmosphere opening is, for example, the time during which the exhaust gas is diluted to the concentration at which dewing does not occur inside the exhaust gas recirculation pipe 1 at an ordinary external temperature. This time can be determined in advance by experiments or calculation, and need not always be limited to a predetermined time. In other words, the exhaust gas recirculation pipe 1 can be closed by measuring the moisture content inside the exhaust gas recirculation pipe 1 by a hygrometer while referring to the external temperature and by confirming that dewing does not occur inside the exhaust gas recirculation pipe 1.

In the second embodiment of the present invention, the exhaust gas recirculation pipe 1 can be opened to the atmosphere after completion of the recirculation of the exhaust gas. Therefore, the combustion gas inside the exhaust gas recirculation pipe can be emitted to the atmosphere. Due to this atmospheric emission, the moisture inside the exhaust gas recirculation pipe 1 can be escaped, the moisture concentration (vapor partial pressure) inside the exhaust gas recirculation pipe 1 can be lowered, and dewing can be prevented eventually.

When the three-way valve 22 capable of functioning also as the EGR valve is used for the atmosphere open valve, the number of components can be decreased, and control of the valve can be made easier.

At the time of EGR, this three-way valve 22 is controlled to the state shown in FIG. 4(*b*) and EGR is effected. At the time of atmospheric opening, the three-way valve 22 is controlled to the state shown in FIG. 4(*c*) and the exhaust gas recirculation pipe 1 can be opened to the atmosphere. After the predetermined time passes and the major proportion of the moisture and other gas components inside the exhaust gas recirculation pipe 1 are emitted from this three-way valve 22, the three-way valve 22 is controlled to the state shown in FIG. 4(*a*) and the exhaust gas recirculation pipe 1 can be closed. As the recirculation pipe 1 is so closed, foreign matters such as dust, worms, etc., are prevented from flowing into the exhaust gas recirculation pipe 1 from outside. These operations can be achieved easily by the control of the controller 3.

Accordingly, the apparatus of the present invention can provide the following effects.

Corrosion of the inside of the exhaust gas recirculation pipe by acidic water, which is produced as the soot in the combustion gas dissolves in dewing water, can be prevented. Further, the operation defect and breakage due to the corrosion of the EGR valve main body and the reed value, etc. can be prevented. As a result, durability of the engine and hence, engine life, can be drastically improved.

What is claimed is:

1. An exhaust gas recirculation apparatus including an exhaust gas recirculation pipe equipped with an EGR valve for controlling an exhaust gas recirculation quantity, so disposed as to be connected from an exhaust passage to an intake passage in an internal combustion engine equipped with a supercharger, and a check valve for preventing intake air from flowing into said exhaust gas recirculation pipe when an internal pressure of said exhaust gas recirculation pipe is lower than an internal pressure of said intake passage, disposed at the junction of said exhaust gas recirculation pipe and said intake passage, wherein said check valve has a clearance for communication between said exhaust gas recirculation pipe and said intake passage while said engine stops.

2. An exhaust gas recirculation apparatus according to claim 1, wherein said check valve is a reed valve comprising a flat valve seat and a reed having a warp providing a clearance between said reed and said valve seat at the distal end of said reed, under a free state.

3. An exhaust gas recirculation apparatus according to claim 1, wherein said check valve is a reed valve comprising a flat sheet-like reed under a free state and a valve seat shaped into a convexed shape in such a manner as to define a clearance expanding towards the distal end side of said reed and provided between the reed and the valve seat.

4. An exhaust gas recirculation apparatus including an exhaust gas recirculation pipe so disposed as to be connected from an exhaust passage to an intake passage in an internal combustion engine equipped with a supercharger and a check valve for preventing intake air from flowing into said exhaust gas recirculation pipe when an internal pressure of said exhaust gas recirculation pipe is lower than an internal pressure of said intake passage disposed at the junction between said exhaust gas recirculation pipe and said intake passage, wherein an open valve for opening said exhaust gas recirculation pipe to the atmosphere at completion of recirculation of the exhaust gas is disposed on the exhaust gas recirculation pipe upstream side of said check valve.

5. An exhaust gas recirculation apparatus according to claim 4, wherein said open valve is a three-way valve operating in such a manner as to close said exhaust gas recirculation pipe after opening to the atmosphere for a predetermined time, after said engine stops.

* * * * *